US006017368A

United States Patent [19]

Steinmann

[11] Patent Number: 6,017,368

[45] Date of Patent: Jan. 25, 2000

[54] MICROEMULSION FUEL COMPOSITIONS FOR THE INTERNAL COMBUSTION ENGINE AND FOR OIL FURNACES

[76] Inventor: Henry W Steinmann, 13 Heighwood Trail, Sparta, N.J. 07871

[21] Appl. No.: 09/102,538

[22] Filed: Jun. 22, 1998

[51] Int. Cl.[7] ..... C10L 1/32

[52] U.S. Cl. ..... 44/302; 44/301

[58] Field of Search ..... 44/302

[56] References Cited

U.S. PATENT DOCUMENTS

| | | | |
|---|---|---|---|
| 4,083,698 | 4/1978 | Wenzel et al. | 44/301 |
| 5,004,479 | 4/1991 | Schon et al. | 44/302 |
| 5,404,841 | 4/1995 | Valentine | 44/302 |
| 5,535,708 | 7/1996 | Valentine | 44/301 |
| 5,584,894 | 12/1996 | Peter-Hoblyn et al. | 44/301 |

*Primary Examiner*—Ellen M. McAvoy

[57] ABSTRACT

Low viscosity water-in-oil (W/O) microemulsion fuels, that are stable without any phase separation over a wide range of temperatures including temperatures below the freezing point of water, made by low shear mixing of petroleum products with an additive solution resulting in microemulsion fuels for the internal combustion engine and oil heating furnaces, either plant or home, with said microemulsion fuels having the unique features of enhancing the reduction of the oxides of nitrogen, reducing particulate matter such as smoke in the exhaust gases and flue gases, and neutralizing the sulfur acids derived from the oxidation of the sulfur in the petroleum product that occurs during combustion of the microemulsion fuel thereby resulting in the abatement of air pollution.

21 Claims, No Drawings

MICROEMULSION FUEL COMPOSITIONS FOR THE INTERNAL COMBUSTION ENGINE AND FOR OIL FURNACES

BACKGROUND

Hydrocarbon fuels such as diesel oil and fuel oil are produced by refining crude petroleum. However, petroleum represents a non-renewable resource. Therefore, researchers have dissolved other ingredients such as water-soluble alcohols like methanol and ethanol in hydrocarbon fuels to reduce petroleum consumption. Although the alcohols dissolved in the hydrocarbon fuels have acceptable combustion characteristics, there is a problem of possible phase separation if the fuel tanks become contaminated with a small amount of water. The so called "water bottoms" have an affinity for the water-soluble alcohol resulting in the water-soluble alcohol dissolving in the aqueous phase and causing phase separation which cannot be tolerated.

Wenzel and Steinmann's U.S. Pat. No. 4,083,698 provided a solution to this problem. Specifically, this patent discloses a clear, low viscosity, stable water-in-oil (W/O) microemulsion fuel composition containing both an ethoxylated non-ionic surfactant and an anionic surfactant. This unique combination of surfactants successfully prevented phase separation of a fuel composition containing water , a water-soluble alcohol and a hydrocarbon fuel. Importantly, these microemulsion fuels such as those in which the hydrocarbon is diesel oil had unusually good stability, especially stability below the freezing point of water.

While these fuel compositions containing both ethoxylated non-ionic surfactants and an anionic surfactant represented an improvement over the prior art, the ethoxylated non-ionic surfactants are not entirely satisfactory. The concept, which is a part of this invention, is that the ethoxylated non-ionic surfactants used in such a large amount according to the teachings of U.S. Pat. No. 4,083,698, result in unsatisfactory combustion of the microemulsion fuel and engine performance. Specifically, the ethylene oxide add-on in the surfactants is like ethylene glycol or could even be a precursor for ethylene glycol during combustion and the concept is that these have poor combustion characteristics. Also, the water content of these fuel compositions is not large enough to affect a reduction in the nitrogen oxides (NOx) exhaust emissions in the absence of a NOx scavenger.

For these reasons improvements in U.S. Pat. No. 4,083,698 are needed which will provide better combustion and engine performance for the microemulsion fuels and simultaneously provide environmentally superior microemulsion fuels as substitutes for 100% petroleum products such as diesel oil and fuel oil.

The oxides of nitrogen (NOx) is a serious pollutant from diesel engines and other internal combustion engines. The high ratio of air to fuel and the high temperatures obtained in the combustion of diesel oil fuel lead to high NOx. However, the high ratio of air to fuel is necessary for complete combustion to occur.

There are two problems on the opposite side of the scale. One is particulate matter which can only be reduced by increasing the degree of combustion of the fuel. The other is NOx which tends to increase as the particulate matter is decreased.

The use of W/O microemulsion fuels is the most meaningful way to obtain the balance of good engine performance and abatement of air pollution for internal combustion engines and heating oil or fuel oil furnaces. The oxygen content of the microemulsion fuel which is generally 13–14% by weight in this invention results in more complete oxidation and therefore, lower particulate matter in the exhaust gases. The water in the microemulsion fuel results in a lower temperature of combustion of the microemulsion fuel which tends toward lower NOx. It has been established that the temperature during combustion is a main factor regarding NOx, the lower the temperature the lower the NOx and vice versa.

The water content of the microemulsion fuel becomes the critical parameter. The more water in the formulation the greater the reduction in NOx. However, unfortunately, the greater the water in the formulation the less the engine power or the higher the brake specific fuel consumption (BSFC). So without any NOx scavengers there must be a compromise between NOx reduction and BSFC which is almost entirely dictated by the water content of the microemulsion. There is considerable evidence that a major reduction in NOx requires a high percentage of water in the formulation without the presence of NOx scavengers. But then this leads not only to a high BSFC but also, more incomplete combustion which could result in higher particulate matter in the exhaust gases.

U.S. Pat. No. 5,004,479 by Schon and Hazbun discloses microemulsion fuels. They use unsaturated fatty acids partially neutralized with a nitrogenous base as the anionic surfactant including the use of ammonia which was used in U.S. Pat. No. 4,083,698 by Wenzel and Steinmann. However, they omit the ethoxylated non-ionic surfactants. Schon and Hazbun made a comprehensive study of the extent of neutralization of the unsaturated fatty acid versus the water up-take exhibited by their drawings of FIGS. 1 to 4. Of particular interest to the present invention is their FIG. 1 where ammonia is the nitrogenous base. FIG. 1 shows optimum water up-take when about 80 mole percent of the unsaturated fatty acid is neutralized with ammonia. In their TABLE 1 they teach that the optimum mol percent of the neutralization of the fatty acid of 80% corresponds to a water uptake of 0.20–0.33 grams of water per gram of diesel oil. Then in their TABLE 2 they teach that for E-315/NH3 (80) the percent water by weight in the microemulsion fuel is 15%. However, freezing of the microemulsion fuel occurs at both temperatures of −20° and −10° C. and there is even turbid or phase separation at 0° C. according to their data. This means that if they want the optimum water content for reducing NOx, their microemulsion fuel will not have satisfactory stability at sub-zero temperatures.

In the present invention, the mole percent of the unsaturated fatty acids neutralized with ammonia is 64%. With reference to Schon and Hazbun's FIG. 1, the uptake of water at 64 mole percent neutralization with ammonia is only 0.013 grams of water per gram of diesel oil. The uptake of water in the present invention is about nine times more than this amount which will be shown in the examples.

The reason for the greater uptake of water in this invention is because of the new and novel use of a non-ethoxylated surfactant and a water-insolube aliphatic alcohol melting below 0° C. such as octanol-1 in combination with the anionic surfactant of the ammonium salt of the unsaturated fatty acids. Furthermore, it will be shown that the low temperature stability of the microemulsion fuel is excellent at −15° C. Based on these results, it is believed that the microemulsion fuels of this present invention represent an improvement in the art over those of Schon and Hazbun.

The second point is that Schon and Hazbun rely primarily on the water and methanol content of the microemulsion to reduce the NOx. In this invention the microemulsion fuel also contains water and methanol like in U.S. Pat. No. 4,083,698 but in addition, the NOx scavengers urea and ethyl carbamate are used to enhance the decrease of the NOx at lower water content of the microemulsion so as to also maintain good engine power or low BSFC and achieve a simultaneous decrease in particulate matter in the exhaust gases as described above.

Peter-Hoblyn and Valentine in U.S. Pat. No. 5,584,894 discloses the use of emulsions of water and diesel oil with catalysts to promote the reduction in NOx. High percentages of water are used which they quoted as 15% to 45% for the preferred range. Many emusifiers are mentioned in this patent including the alkyl amines and hydroxyalkylamines reacted with fatty acids but the reaction of ammonia with unsaturated fatty acids and the use of water-insoluble aliphatic alcohols melting below 0° C. and acetylenic non-ethoxylated surfactants are not mentioned in this patent.

A second point relates to the emulsions referred to in their patent. There is no information on the stability of the emulsions at sub-freezing temperatures. The particle size mentioned in their patent in which "at least 70% of the droplets are below about 5 microns" classifies this as an emulsion not a microemulsion. On the other hand, a microemulsion has an average particle size of about 0.01 micron. This invention like U.S. Pat. No. 4,083,698 and U.S. Pat. No. 5,004,479 deals with microemulsions.

In his patents, U.S. Pat. No. 5,404,841 and U.S. Pat. No. 5,535,841, Valentine teaches that the NOx scavenger urea enhances the decrease in NOx and that it is preferrable to have a NOx scavenger in the emulsion and not rely solely on the water content of the emulsion to reduce the NOx. He also mentions ammonium carbamate as a NOx savenger in addition to many others. He describes the SNCR reducing process (selective non-catalytic) but he also discloses a catalytic process (SCR) for reducing NOx.

Previous patents and literature on water injection systems for exhaust gases teach that urea is an effective NOx scavenger. It is believed that the mechanism involves the formation in part of ammonia from urea with the ammonia actually being the reducing agent for NOx. In fact, aqueous ammonia solutions for the water injection system are very effective in reducing NOx.

Like the patent of Peter-Hoblyn and Valentine, the Valentine patents involve emulsions of large particle size compared to microemulsions with much smaller micelle size as explained above. Again, no information is given on the stability of these emulsions at sub-freezing temperatures. It is stated that the reason for the recirculation line shown in his drawing is "to maintain emulsion stability".

In contrast, the microemulsion of this invention has indefinite storage stability. The appearance, viscosity and flow properties of the microemulsion of this invention is so similar to that of 100% diesel oil that it is difficult to distinguish one another by visual examination. The advantages of the stability of the microemulsions over long storage periods and also at sub-freezing temperatures of this invention and still containing NOx scavengers in contrast to the Valentine emulsions with diesel oil are apparent and considered to represent an improvement in the art. A novel concept of this invention will be described to show that ethyl carbamate is considered to be superior to ammonium carbamate as a NOx scavenger.

The basic idea in this invention regarding a solution to the problems of particulate matter and NOx, is to maintain a comparatively low water content of the microemulsion fuel to promote complete combustion resulting in acceptable BSFC's and low particulate matter and simultaneously achieve a good NOx reduction by means of NOx scavengers present in the formulations of the W/O microemulsion fuels. An important criterion of this invention is that the microemulsion fuels with diesel oil have indefinite storage stability and maintain good stability at sub-freezing temperatures so that there is not any phase separation and that the microemulsion fuel has good fluidity for transport in the fuel lines even at sub-freezing temperatures. It is believed that the concepts and ideas of this invention represent an improvement in the art of microemulsion fuels made with diesel oil and heating oil or fuel oil.

SUMMARY OF THE INVENTION

The first objective is to provide low viscosity, stable W/O) microemulsion fuels made from mixing diesel oil or fuel oil with additives that give excellent engine performance in the internal combustion engine and efficient combustion in oil heating furnaces.

A second objective is to abate air pollution by reducing particulate matter such as smoke in the exhaust gases from diesel engines and in the flue gases from oil heating furnaces.

A third objective is to abate air pollution by enhancing the reduction of the oxides of nitrogen (NOx) in the exhaust gases from diesel engines and in the flue gases from oil heating furnaces by means of NOx scavengers present in the microemulsion fuel.

A fourth objective is to stoichiometrically neutralize the sulfur acids generated from the oxidation of the sulfur in the diesel oil and fuel oil which occur when the microemulsions containing the diesel oil or fuel oil undergo combustion. This coupled with the reduction in nitrogen oxides reduces acid rain.

A fifth objective is to replace in part petroleum products such as diesel oil and fuel oil with renewable sources of energy such as the utilization of fatty acids from vegetable oils such as soybean oil.

These objectives are achieved as a result of several key ideas and concepts of this invention:

1. The concept that ethylene oxide in non-ionic surfactants has poor combustion characteristics and that ethylene glycol which may be produced insitu has poor combustion characteristics like glycerine. Ideas that were created to put this concept into practice were:

(a) Eliminate the ethoxylated non-ionic surfactant.

(b) Replace the ethoxylated non-ionic surfactant in the microemulsion fuel with a non-ionic surfactant that does not have any ethylene oxide in it.

(c) Replace the ethoxylated non-ionic surfactant in the microemulsion fuel with long chain water-insoluble aliphatic alcohols having melting points below 0° C.

2. The concept that NOx scavengers are needed in the microemulsion fuel to significantly reduce the oxides of nitrogen in the exhaust gases and flue gases with a water content of the microemulsion fuel being less than 10% and preferably from 5 to 8%.

(a) Use urea as a NOx scavenger in which urea is a precursor to ammonia as the reducing agent to reduce the oxides of nitrogen to non-toxic nitrogen. The urea is a component of the microemulsion fuel.

(b) Use ethyl carbamate as a NOx scavenger. The concept is that the ethyl carbamate first hydrolyzes to ethyl alcohol and carbamic acid in the combustion chamber.

The ethyl alcohol combusts and the carbamic acid produced insitu decomposes readily to ammonia and carbon dioxide. The ammonia reduces the oxides of nitrogen. The ethyl carbamate is a component of the microemulsion fuel. The key to this concept is that the ammonia is produced in the later stages of the combustion which is desirable.

(c) Use a combination of (a) and (b).

3. The concept that the sulfur in petroleum products such as diesel oil and fuel oil oxidize to sulfur oxides like sulfur dioxide in the combustion chamber and the sulfur oxides combine with steam in the exhaust gases to produce sulfur acids such as sulfurous acid which pollutes the air. Further to this concept is that the combination of oxides of nitrogen and the sulfur acids result in acid rain which is detrimental to vegetation.

The idea created is to stoichiometrically neutralize the sulfur acids generated in the combustion chamber by adding an alkaline substance like sodium bicarbonate or sodium carbonate to the microemulsion fuel.

The above objectives of this invention and the above concepts and ideas to achieve these objectives are embodied in the new and novel microemulsion fuel compositions by weight which are summarized as follows:

(a) Diesel oil or fuel oil comprising about 50 to 90% of the microemulsion fuel.

(b) An anionic surfactant prepared from the partial neutralization of 60 to 70 mole percent of the unsaturated fatty acids with ammonia such that there results both free fatty acids and the ammonium salts of the fatty acids. The ammonium salts of the fatty acids which represent the anionic surfactant comprise about 4 to 12% by weight of the microemulsion fuel. The free fatty acids comprise about 2 to 6% by weight of the microemulsion.

(c) A non-ethoxylated non-ionic surfactant. The specific surfactant, which is a novel part of this invention, is 2,4,7,9 tetramethyl-5-decyne-4,7 diol, manufactured by Air Products and Chemicals, Inc. under the trade name of Surfynol 104. When this surfactant is dissolved in 2-ethylhexanol-1 as a 50% solution by weight it is called Surfynol 104A. The surfactant and the solvent comprise about 1 to 2% each by weight of the microemulsion. This surfactant is also called "Acetylenic Diol Surfactant" which name will be used in the examples.

(d) Long chain water-insoluble or slightly soluble in water aliphatic alcohols with melting points below 0° C., for example, octanol-1, comprising 2 to 8% by weight of the microemulsion.

(e) The sodium salts of the fatty acids to stoichiometrically neutralize the sulfur acids generated from the oxidation of sulfur in diesel oil or fuel oil during combustion with the amount of the sodium salts comprising about 0.2 to 0.5% by weight of the microemulsion fuel. The amount of sodium salts required is dependent on both the sulfur content of the diesel oil and fuel oil and also, the percentage of diesel oil or fuel oil used in the microemulsion fuel.

(f) Water-soluble aliphatic alcohols such as methanol and ethanol comprising about 5 to 14% of the microemulsion fuel.

(g) Total water in the microemulsion comprising about 1 to 10% of the microemulsion fuel.

(h) Urea NOx scavenger comprising about 0.1 to 4.0% by weight of the microemulsion fuel.

(i) Ethyl carbamate NOx scavenger comprising about 0.1 to 4.0% by weight of the microemulsion fuel.

The first step in the preparation of the water-in-oil microemulsion fuel is to prepare the solution of additives. In preparing this solution there is no particular order of adding the components except that the aqueous ammonia is added last. However, there is one exception to this. For solutions containing ethyl carbamate, the aqueous ammonia is added before the ethyl carbamate to assure that none of the ethyl carbamate will hydrolyze.

The second step is the mixing of the solution of additives with the petroleum product such as diesel oil. One of the advantages of the microemulsions of this invention is that only very low shear mixing is necessary to prepare the water-in-oil microemulsion fuels.

DETAILED DESCRIPTION OF THE INVENTION

This invention relates to low viscosity, stable (W/O) microemulsions prepared by mixing petroleum products such as diesel oil and fuel oil with a solution of additives. The microemulsions are crystal clear at room temperature but like diesel oil and heating fuel oil, they become hazy at sub-freezing temperatures but with the important characteristics that there is not any phase separation and that they have good fluidity like diesel oil itself.

The solution of additives is a clear, low viscosity and stable molecular solution. It is prepared separately and can be stored separately until ready to use when preparing the microemulsions fuel.

The microemulsion is readily prepared by mixing the petroleum product with the solution of additives at room temperature. On a large scale the microemulsion can be prepared by feeding the solution of additives and the petroleum product from the respective storage tanks through separate pipe lines into a common pipe line that leads to a storage tank for the microemulsion fuel. The flow rates are monitored to deliver the preferred blend of the solution of additives with the petroleum product. For example, a preferred blend of v/v 65/35 diesel oil/additive solution is continuously prepared in which the flow rate of the diesel oil is 1.857 times the flow rate of the solution of additives for the same pipe diameter. The flow rates are readily maintained because of the low viscosities and easy transport of both the solution of additives and the diesel oil.

THE FUNDAMENTAL COMPONENTS OF THIS INVENTION

The solution of additives comprise six fundamental components described below.

1. An anionic surfactant prepared by the neutralization of 60 to 70% of the unsaturated fatty acids with ammonia such that there results both the ammonium salts of the fatty acids which represent the anionic surfactant and free fatty acids.

2. A non-ethoxylated non-ionic surfactant, the acetylenic diol surfactant, 2,4,7,9-tetramethyl-5-decyne-4,7-diol dissolved in 2-ethylhexanol-1.

3. Long chain, water-insoluble aliphatic alcohols with melting points below 0° C. such as octanol-1.

4. Water-soluble aliphatic alcohols such as methanol and ethanol.

5. Water.

6. NOx scavengers urea and ethyl carbamate..

Item 1

Unsaturated fatty acids derived from vegetable oils such as soybean oil which consist of oleic acid, linoleic acid and linolenic acid which comprise at least 90% of the fatty acids are used. Present in the unsaturated fatty acids are minor percentages of saturated fatty acids such as stearic acid and palmitic acid that make up less than 10% of the fatty acids.

The fatty acids are neutralized with aqueous ammonia to the extent of 60–70 mole percent to form the ammonium salts of the fatty acids which represents the anionic surfactant. There remains 30–40% free fatty acids.

Item 2

The non-ionic surfactant that is not ethoxylated represents a novel part of this invention. It is 2,4,7,9-tetramethyl-5-decyne-4,7-diol which is dissolved in 2-ethylhexanol-l resulting in a 50% solution by weight.

Item 3

The long-chain water-insoluble aliphatic alcohols having melting points below 0° C. represent a novel part of this invention for two basic reasons, namely, they enhance the stability of the microemulsion making it possible to replace the ethoxylated non-ionic surfactants and secondly, they have excellent combustion characteristics. A preferred long-chain water-insoluble aliphatic alcohol is octanol-1 because it has both excellent solubility characteristics and the desirable melting point of −16.7° C.

The criterion is that the long-chain water-insoluble aliphatic alcohol must have a melting point below the freezing point of water in order to enhance the low temperature stability of the microemulsion. Examples of some water-insoluble aliphatic alcohols with their respective melting points in ° C. besides octanol-1 are amyl alcohol (−78.9), hexanol-1 (−51.6), octanol-2 (−38), 2-ethylhexanol-1 (−76), nonanol-2 (−35) and nonanol-3 (−22).

Item 4

The preferred water-soluble aliphatic alcohols are methanol and ethanol. Methanol is particularly desirable for several reasons such as imparting low temperature stability to the microemulsion and enhancing complete combustion. Since methanol contains about 50% oxygen, it contributes greatly to the supply of oxygen in the microemulsion fuel. The oxygen content of the microemulsion is important in enhancing complete combustion and achieving removal of particulate matter like smoke.

When ethanol is used it is preferred to use it in a blend with methanol such as in v/v 75/25 methanol/ethanol. It is preferred to use 95% ethanol which is more economical and practical to use compared to 100% ethanol since microemulsions already contain water.

Item 5

Water is a key component of the microemulsion. Softened water should be used to prevent any build-up of bivalent salts on the engine parts such as calcium salts. The water content of the microemulsion is critical. A comparatively large water content tends to give a lower NOx, however, it also tends to give a significant loss in engine power. The only practical solution to this problem is to have a NOx scavenger in the formulation so that there is obtained both satisfactory engine power or BSFC and a significant reduction in NOx. A preferred range is 5 to 8% water in the microemulsion fuel.

Item 6

It is well known that the injection of aqueous solutions of ammonium hydroxide or aqueous solutions of urea into the exhaust gases of the internal combustion engine and into flue gases from power plants significantly reduce the oxides of nitrogen (NOx). There are numerous patents and technical papers on this subject some of which are catalytic called Selective Catalytic Reduction (SCR) and some of which are non-catalytic called Selective Non-Catalytic Reduction (NSCR). Two references on the injection of aqueous solutions cited are Ger. Offen. DE 4,315,385, Nov. 10, 1994, Lippmann et al. and JP 06,165,913, Jun. 14, 1994, Imada et al.

The fundamental chemistry in both the SCR and NSCR systems is similar. It is based on ammonia acting as a reducing agent in the exhaust system in which there is a depletion of oxygen due to combustion resulting in more of a reducing atmosphere as opposed to an oxidizing atmosphere. The aqueous injection of ammonia into the exhaust gases is more direct from the basic chemistry viewpoint.

Urea which is non-toxic can also be used because it is known to decompose in part to ammonia.

The reduction of NOx with ammonia gives the non-toxic nitrogen gas according to the following equation:

$$6\ NOx + 4x\ NH_3 \longrightarrow (2x+3)\ N_2 + 6x\ H_2O$$

The concept in this invention is to incorporate the NOx scavengers in the microemulsion fuel itself. There are two distinct advantages of having the NOx scavengers in the microemulsion fuel, namely, it eliminates the need for aqueous solution injection systems and it gives more time for the scavengers to operate.

Urea can be used directly in the water-in-oil microemulsion. In fact, there is a time delay for the urea to produce ammonia which is actully an advantage because the later stage of the combustion represents more of a reducing atmosphere than the beginning of the combustion.

On the other hand, only minimum ammonia such as the amount to neutralize 60–70% of the fatty acids should be used directly in the microemulsion fuel. The reason is that the ammonia is subjected to an oxidizing atmosphere when the microemulsion fuel is sprayed into the combustion chamber and could oxidize to nitric oxide in the early stages of the combustion when the oxygen content is high according to the following equation:

$$4\ NH_3 + 5\ O_2 \longrightarrow 4\ NO + 6\ H_2O$$

Therefore, in the early stages of the combustion when the oxygen content is high it is preferred to have a minimum amount of ammonia. However, in the later stages of the combustion when considerable oxygen has been consumed by the combustion of the microemulsion fuel, it is preferred to have sufficient ammonia for the reduction of NOx. What is needed is a delay reaction that produces ammonia insitu later when a considerable amount of the oxygen has been depleted due to combustion and there is present more of a reducing atmosphere for the ammonia to act as a reducing agent. This is the concept of using urea and ethyl carbamate to produce ammonia later in the combustion.

Ethyl carbamate is preferred over ammonium carbamate because it must first be hydrolyzed to carbamic acid before ammonia is released via decomposition of the carbamic acid. On the other hand, ammonium carbamate will release ammonia immediately on being sprayed into the combustion chamber which is too soon because the ammonia is subject to oxidation in the early stages of combustion.

A new and novel idea of this invention is to use ethyl carbamate as a component in the microemulsion fuel. This can be a component of the water-in-oil microemulsion because it has excellent solubility characteristics. The ammonia is "locked" into the molecule and the micelles are perfectly stable. When the microemulsion fuel is sprayed into the combustion chamber, the water vapor (steam) that is present hydrolyzes the ethyl carbamate to ethyl alcohol and carbamic acid. The ethyl alcohol combusts readily adding to the power. However, the resulting carbamic acid is unstable and breaks down to ammonia and carbon dioxide. By means of this mechanism, the ammonia is produced ideally later in the combustion stage in which there is more of a reducing atmosphere for the generated ammonia to reduce NOx.

The oil-in-water microemulsion fuels of this invention have a low water content which give low particulate matter such as smoke in the exhaust gases. Furthermore, the engine power is maximized and the BFSC minimized with the low water content of the microemulsion fuel. Now by having NOx scavengers in the water-in-oil microemulsion fuel that give a delay in producing ammonia in the later stages of combustion, both a reduction in particulate matter and a decrease in NOx are achieved.

THE ACID RAIN PROBLEM

Since it is desirable to remove oxides of nitrogen and particulate matter such as smoke from the exhaust gases of the internal combustion engine and from the flue gases of fuel oil furnaces, it is also desirable to neutralize the sulfur acids because the combination of oxides of nitrogen and the sulfur acids cause acid rain. Adding mixtures of ammonia and sodium hydroxide to partially neutralize the fatty acids was disclosed in U.S. Pat. No. 4,083,698 so the idea of using some sodium salts of the unsaturated fatty acids in addition to the ammomnium salts is not new. The important distinction made in this invention is that the amount of the sodium salt of the fatty acids is stoichiometric with the sulfur acids generated from the oxidation of the sulfur in the diesel oil and the fuel oil. So the idea is to add the stoichiometric amount of sodium bicarbonate or sodium carbonate with the aqueous ammonia when partially neutralizing the unsaturated fatty acids so that the sodium salt of the carboxylic acid will be present in the microemulsion fuel. This will react with the stronger sulfur acids such as sulfurous acid as illustrated by the equation shown below.

$$2\ R{-}COONa + H_2SO_3 \longrightarrow 2\ R{-}COOH + Na_2SO_3$$

where R=the fatty acid chain

Of course, the R—COOH combusts and the sodium sulfite formed (also sodium sulfate if any sulfuric acid is present) is practically neutral thereby eliminating acid rain.

HEATING OIL FOR OIL FURNACES IN POWER PLANTS AND HOME

Heating oil or Fuel oil is classified as #2 fuel oil/#2 diesel oil because it is derived from the same fraction as diesel oil in the cracking of petroleum. Therefore, the main properties of fuel oil are similar to those of diesel oil such as specific gravity and viscosity. It is apparent, then, that the basic fundamentals of the microemulsion fuels made with diesel oil also apply to heating oil or fuel oil for the oil furnaces of power plants and for home furnaces.

The microemulsions made with heating oil or fuel oil should have good combustion characteristics tending toward more complete combustion and less soot or particulate matter. It is expected that very clean and complete combustion with less soot will occur in the oil furnaces.

Since this invention includes NOx scavengers and the concept of adding the stoichiometric amount of sodium bicarbonate or sodium carbonate to the microemulsion for the purpose of neutralizing sulfur acids generated from the oxidation of sulfur in diesel oil during combustion, these same additives can be used for heating oil or fuel oil. In addition to the more efficient combustion with much less formation of soot, the flue gases would be much less harmful to the environment thereby abating air pollution from power plants and home furnaces that utilize heating oil or fuel oil.

Specific examples of embodiments prepared in accordance with this invention will now be described in detail. These examples are intended to be illustrative and therefore, this invention is not limited to the materials or methods set forth in these examples.

All of the examples relate to certain specific definitions which are described as follows:

(a) The numerical values in each formulation.

The numerical value for a component of a formulation is a volume of the component with the exception of the NOx scavengers, urea and ethyl carbamate, the sodium bicarbonate used to form sodium oleate for neutralizing sulfur acids and the solvent 2-ethylhexanol-1 which are expressed as weights. For large scale microemulsion fuels the volumes are expressed in U.S. gallons (gals). For small scale experiments the volumes are expressed in milliliters (mls). Since there are 3785.3 milliliters per gallon, one can use the same numerical value for gallons as for milliliters if the gallons are multiplied and then divided by 3785.3. For example, 30 gallons of oleic acid equals (30)(3785.3) mils. Then for a small scale experiment divide this by 3785.3 giving 30 mls. Now for the weights of urea and ethyl carbamate, one must divide the grams used with the gallons of components by 3785.3 for the grams in a small scale experiment. For example, if 8.328 kilograms or 8328 grams of urea are used with gallons of the other components, then 8328/3785.3 which equals 2.20 grams of urea is used with milliliters of the other components.

(b) The unsaturated fatty acids in each formulation.

Oleic acid is used for the examples shown. However, a mixture of fatty acids can also be used such as Emersol 315 Linoleic Acid manufactured by Henkel Corp. Actually, Emersol 315 is a mixture of fatty acids comprising 60% linoleic acid, 25% oleic acid, 9% linolenic acid, 4% palmitic acid, 1% myristic acid and 1% stearic acid. In Emersol 315, 94% of the fatty acids are unsaturated fatty acids and only 6% are saturated fatty acids.

(c) Surfynol 104A Surfactant.

This non-ionic surfactant that is not ethoxylated is manufactured by Air Products and Chemicals, Inc. It is Surfynol 104 and when it is dissolved in 2-ethylhexanol-1 as a 50% solution by weight, the solution is called Surfynol 104A. This solution has a specific gravity of 0.87. A volume of Surfynol 104A is used when it is a component of a formulation. In the examples, 5 mls of Surfynol 104A are used for some of the small scale experiments. This gives a weight of 4.4 grams in which 2.2 grams represent the non-ionic non-ethoxylated surfactant Surfynol 104 and 2.2 grams represent the solvent 2-ethylhexanol-1.

For large scale formulations, 5 gals of Surfynol 104A give 18.926 kg of solution of which 9.463 kg represent the non-ionic surfactant Surfynol 104 and 9.463 kg represent the solvent 2-ethylhexanol-1.

Surfynol 104 is a diol with the chemical name of 2,4,7,9 tetramethyl-5-decyne-4,7 diol. For convenience, it is also called an Acetylenic Diol Surfactant which name will be used in the examples.

Surfynol 104A is excellent for this invention for two reasons: (i) it contains a powerful non-ionic, non-ethoxylated surfactant and (ii) it contains the solvent 2-ethylhexanol-1 which falls under the category of a water-insoluble long-chain aliphatic alcohol melting below 0° C. which is a new and novel part of this invention.

(d) In order to determine the weight composition of each formulation, the specific gravity of each component must be used to convert from volume to weight. Thus, 30 mls oleic acid equals (30)(0.89) or 26.7 grams. Then the specific gravity of the entire additive is determined. Using 0.84 for the specific gravity of diesel oil, the v/v composition of the microemulsion fuel can be converted to a w/w composition. For example, a v/v 65/35 diesel oil/additive in which the specific gravity of the additive solution is 0.88, has a w/w composition of 63.9/36.1.

EXAMPLE 1

Ammonium Oleate Anionic Surfactant in Combination with Octanol-2 and the Acetylenic Diol Non-Ionic Surfactant

| Experiment Number | 1 | 2 | 3 |
|---|---|---|---|
| Oleic acid | 30 | 30 | 30 |
| Octanol-2 | 10 | 10 | 10 |
| Acetylenic Diol Surfactant, gms. | 2.2 | 2.2 | 2.2 |
| 2-Ethylhexanol-1, gms | 2.2 | 2.2 | 2.2 |
| Methanol | 28 | 28 | 0 |
| 95% Ethanol . | 0 | 0 | 28 |
| Added water . | 12.8 | 12.8 | 17.6 |
| 29% Aqueous Ammonia | 4.0 | 4.0 | 4.0 |
| Urea, gms. | 2.20 | 0 | 0 |
| Ethyl Carbamate, gms. | 0 | 2.20 | 2.20 |

The procedure consists of making a solution of the first six components listed in the above formulation, adding the solution of urea in the added water, adding the aqueous ammonia and finally adding the ethyl carbamate. The mole percent of the oleic acid neutralized with ammonia is 64% so that after the reaction of the oleic acid with ammonia which is exothermic, the reaction product is ammonium oleate which is the anionic surfactant. The unreacted oleic acid is called free oleic acid. Note that the ethyl carbamate is added after the neutralization reaction to assure that none of it hydrolyzes. Also, experiments #1 and #2 contain methanol but experiment #3 contains 95% ethanol to study the effect of the water-soluble alcohol on the low temperature stability of the microemulsion fuel.

The clear additive solution is blended with diesel oil by hand stirring to prepare a v/v 65/35 diesel oil/additive microemulsion fuel.

All three microemulsion fuels were crystal clear at room temperature when they were prepared. They were put in a freezer at −15° C. overnight and then examined right after removing the samples from the freezer. All three microemulsions were only slightly more hazy than the diesel oil control but very fluid like diesel oil without any phase separation.

The three samples were rated as having excellent low temperature stability. This shows that the combination of a long chain water-insoluble aliphatic alcohol like octanol-2 in combination with the acetylenic diol surfactant along with the anionic surfactant is effective in imparting low temperature stability to the microemulsion.

When the samples were warmed, the haze slowly decreasesd until complete clearing occurred. The sample of Expt. 3 completely cleared at 1° C. compared to the diesel oil control sample which cleared at 0° C. However, samples of Expts. 1 and 2 completely cleared at 4° C. This shows that ethanol gives better low temperature stability at the target water content of 7.00% in the microemulsion fuel than methanol for microemulsion fuels containing either urea or ethyl carbamate NOx scavenger.

Since the degree of neutralization of the oleic acid with ammonia is 64 mole percent, Schon and Hazbun would have expected a water uptake of only 0.013 gram of water per gram of diesel oil in their formulation according to their FIG. 1 of of U.S. Pat. No. 5,004,479. However, as shown by the weight percentage analyses of the microemulsion fuels of TABLE 1 below, the water uptake for each of the experiments is 0.11 gram of water per gram of diesel oil which is 8.5 times more than what Schon and Hazbun's FIG. 1 would have predicted. This is because the microemulsion fuel of this invention contains the water-insoluble long chain aliphatic alcohol and the acetylenic diol surfactant in addition to the ammonium oleate anionic surfactant which not only increases the tolerance for water but enhances the stability of the micromulsion fuel at sub-freezing temperatures.

The Percent Weight Compositions of the microemulsion fuels are shown in TABLE 1.

TABLE 1

Comparison of the Percent Weight Compositions of the Microemulsions of Experiments #1, #2 and #3.

| Experiment Number | 1 | 2 | 3 |
|---|---|---|---|
| Diesel Oil | 63.40 | 63.40 | 63.70 |
| Free Oleic Acid | 4.40 | 4.40 | 4.43 |
| Ammonium oleate | 8.38 | 8.38 | 8.43 |
| Octanol-2 | 3.75 | 3.75 | 3.77 |
| Acetylenic Diol Surfactant | 0.99 | 0.99 | 1.00 |
| 2-Ethylhexanol-1 | 0.99 | 0.99 | 1.00 |
| Methanol | 10.10 | 10.10 | 0.00 |
| Ethanol (Calcd. as 100%) | 0.00 | 0.00 | 9.63 |
| Total water | 6.99 | 6.99 | 7.04 |
| Urea | 1.00 | 0.00 | 0.00 |
| Ethyl Carbamate | 0.00 | 1.00 | 1.00 |

EXAMPLE 2

The Effect of Octanol-1 Versus a Combination of Octanol-1 and Acetylenic Diol Surfactant on the Low Temperature Stability of Microemulsions.

Three formulations were investigated in which one of them contained a combination of octanol-1 and acetylenic diol surfactant and the other two had only octanol-1 at different levels. All three of them contained a stoichiometric amount of sodium oleate for the purpose of neutralizing sulfur acids formed by the oxidation of sulfur in the diesel oil during combustion. The components of the formulations are shown below.

| Experiment Number | 4 | 5 | 6 |
|---|---|---|---|
| Oleic acid | 30 | 30 | 30 |
| Octanol-1 | 10 | 10 | 15 |
| Acetylenic Diol Surfactant, gms. | 2.2 | 0 | 0 |
| 2-Ethylhexanol-1, gms. | 2.2 | 0 | 0 |
| Methanol | 21 | 21 | 21 |
| 95% Ethanol | 7 | 7 | 7 |
| Added water | 10 | 10 | 10 |
| 29% Aqueous Ammonia | 4.0 | 4.0 | 4.0 |
| Urea, gms. | 2.14 | 2.14 | 2.14 |

-continued

| Experiment Number | 4 | 5 | 6 |
|---|---|---|---|
| Sodium Bicarbonate, gms. | 0.14 | 0.14 | 0.14 |

The urea and the sodium bicarbonate were dissolved in the added water. This solution was added to the solution of the first six components of the above formulation and then the aqueous ammonia added. There resulted a clear solution for each experiment in which each was hand stirred with diesel oil to prepare the respective miocroemulsion fuel.

The v/v 65/35 diesel oil/Additive microemulsions were crystal clear at room temperature. They were placed in a freezer at −15° C. for one day and then evaluated.

The microemulsions from the freezer were hazy like diesel oil. They were very uniform and very fluid. When they were warmed toward 0° C., #4 and #5 behaved the same in which the haze completely disappeared at 3° C. giving clear microemulsions. Since the formulation of #4 contained 10 mls of octanol-1 plus 2.2 grams of the acetylenic diol surfactant whereas #5 contained 10 mls of octanol-1 without any acetylenic diol surfactant, the conclusion is that octanol-1 alone is as effective as the combination of octanol-1 and the acetylenic diol surfactant regarding the low temperature stability of the microemulsion at the particular water content and urea content of these microemulsions. However, it is important to note that this conclusion applies to these specific formulations and is not a general conclusion. It is believed that the combination of the non-ionic surfactant and the water-insoluble long-chain aliphatic alcohol is generally best for the low temperature stability of any microemulsion.

The microemulsion of #6 in which there were 15 mls of octanol-1, cleared at 0° C., the same temperature of clearing for diesel oil. Therefore, increasing the amount of octanol-1 in the formulation (compared to #5) further enhanced the low temperature stability of the microemulsion. This confirms one of the concepts of this invention that the water-insoluble long-chain aliphatic alcohols melting below 0° C. impart low temperature stability to the microemulsions.

The weight percentage compositions of the three microemulsions are shown in TABLE 2.

TABLE 2

Percent Weight Compositions of Microemulsions from the Formulations of Experiments #4, #5 and #6

TABLE 2

| Experiment Number | 4 | 5 | 6 |
|---|---|---|---|
| Diesel oil | 63.70 | 63.70 | 63.70 |
| Free oleic acid | 4.29 | 4.57 | 4.31 |
| Ammonium oleate | 8.60 | 9.13 | 8.63 |
| Sodium oleate | 0.24 | 0.24 | 0.24 |
| Octanol-1 | 3.88 | 4.12 | 5.83 |
| Acetylenic Diol Surfactant | 1.02 | 0 | 0 |
| 2-Ethylhexanol-1 | 1.02 | 0 | 0 |
| Methanol | 7.78 | 8.26 | 7.80 |
| Ethanol (Calcd. as 100%) | 2.45 | 2.60 | 2.46 |
| Water | 6.02 | 6.38 | 6.03 |
| Urea | 1.00 | 1.00 | 1.00 |

EXAMPLE 3

Investigation of the Effect of Decreasing the Oleic Acid and Increasing the Octanol-1.

The purpose of this experiment is to determine if decreasing the amount of anionic surfactant (ammonium oleate) and simultaneously, increasing the octanol-1, will give a stable microemulsion at sub-freezing temperatures.

| Experiment Number | 7 |
|---|---|
| Oleic acid | 20 |
| Octanol-1 | 15 |
| Acetylenic Diol Surfactant, gms. | 2.2 |
| 2-Ethylhexanol-1, gms. | 2.2 |
| Methanol | 21 |
| 95% Ethanol | 7 |
| Added water | 9.8 |
| 29% Aqueous Ammonia | 2.7 |
| Urea, gms. | 1.97 |

The v/v 65/35 diesel oil/Additive microemulsion was prepared. It was crystal clear at room temperature. It was placed in the freezer at −15° C. for nine days and then evaluated. It had much less haze than the 100% diesel oil control and was very fluid. When the sample was warmed clearing took place faster than usual and the sample was completely clear at −1° C. which is even lower than the clearing temperature of diesel oil which is 0° C.

The conclusion is that decreasing the oleic acid and increasing the octanol-1 in the formulation enhances the low temperature stability of the microemulsion.

The percent weight composition of the microemulsion is shown in TABLE 3

TABLE 3

The Percent Weight Composition of the Microemulsion from the Formulation of Experiment #7

TABLE 3

| Experiment Number | 7 |
|---|---|
| Diesel oil | 63.90 |
| Free oleic acid | 3.20 |
| Ammonium oleate | 6.26 |
| Octanol-1 | 6.32 |
| Acetylenic Diol Surfactant | 1.11 |
| 2-Ethylhexanol-1 | 1.10 |
| Methanol | 8.45 |
| Ethanol (Calcd. as 100%) | 2.67 |
| Water | 5.99 |
| Urea | 1.00 |

EXAMPLE 4

The Effect of Replacing Part of the Oleic Acid with Octanol-1 on the Addition of Higher Melting Water-Insoluble Aliphatic Alcohols The power of octanol-1 in enhancing the low temperature stability of microemulsions makes it possible to add higher percentages of water-insoluble aliphatic alcohols that have melting points above 0° C. Three experiments were made using a comparatively high percentage of oleyl alcohol which melts above 0° C. (6–7° C.).

| Experiment Number | 8 | 9 | 10 |
|---|---|---|---|
| Oleic acid | 20 | 20 | 20 |
| Octanol-1 | 20 | 20 | 20 |
| Acetylenic Diol Surfactant, gms. | 2.2 | 2.2 | 2.2 |

-continued

| Experiment Number | 8 | 9 | 10 |
|---|---|---|---|
| 2-Ethylhexanol-1, gms. | 2.2 | 2.2 | 2.2 |
| Oleyl alcohol | 10 | 10 | 10 |
| Methanol | 21 | 21 | 21 |
| 95% Ethanol | 7 | 7 | 7 |
| Added water | 12.4 | 12.4 | 12.4 |
| 29% Aqueous Ammonia | 2.7 | 2.7 | 2.7 |
| Urea, gms. | 2.40 | 0 | 2.40 |
| Ethyl carbamate, gms. | 0 | 2.40 | 2.40 |
| Sodium bicarbonate, gms. | 0.16 | 0.16 | 0.16 |

The urea and the sodium bicarbonate were dissolved in the added water and then this solution added to the solution of oleic acid, octanol-1, oleyl alcohol, Acetylenic Diol Surfactant solution, methanol and 95% ethanol. Then the aqueous ammonia was added to make a clear, low viscosity solution. Then for experiments 9 and 10, the ethyl carbamate was dissolved in the additive solution.

Microemulsions of v/v 65/35 diesel oil/Additive were prepared. They were crystal clear at room temperature. The samples were placed in the freezer at −15° C. overnight. They were then examined and found to be more hazy than the diesel oil control, however, there was not any phase separation.

When the samples were warmed, clearing occurred at +2° C. for each of the samples. The three samples were rated as having good low temperature stability.

This set of experiments confirms the power of octanol-1 in enhancing the low temperature stability of the microemulsions enabling one to use a large percentage of a higher melting water-insoluble long chain aliphatic alcohol in the formulation.

The percent weight compositions of these microemulsions are shown in TABLE 4.

TABLE 4

Percent Weight Compositions of Microemulsions in Which Part of the Oleic Acid Is Replaced with Octanol-1 and Contained a High Percentage of Oleyl Alcohol.

TABLE 4

| Experiment Number | 8 | 9 | 10 |
|---|---|---|---|
| Diesel oil | 63.90 | 63.90 | 63.20 |
| Free oleic acid | 2.39 | 2.39 | 2.37 |
| Ammonium oleate | 5.13 | 5.13 | 5.08 |
| Sodium oleate | 0.24 | 0.24 | 0.24 |
| Octanol-1 | 6.90 | 6.90 | 6.84 |
| Acetylenic Diol Surfactant | 0.90 | 0.90 | 0.90 |
| 2-Ethylhexanol-1 | 0.91 | 0.91 | 0.90 |
| Oleyl Alcohol | 3.53 | 3.53 | 3.50 |
| Methanol | 6.92 | 6.92 | 6.86 |
| Ethanol (Calcd. as 100%) | 2.18 | 2.18 | 2.16 |
| Water | 6.00 | 6.00 | 5.95 |
| Urea | 1.00 | 0.00 | 1.00 |
| Ethyl carbamate | 0.00 | 1.00 | 1.00 |

W/O microemulsion Investigations were made using heating oil, urea and ethyl carbamate NOx scavengers, the stoichiometric amount of sodium bicarbonate required to neutralize sulfur acids generated during combustion via the oxidation of sulfur present in heating oil, octanol-1 and the acetylenic diol non-ionic surfactant.

The heating oil was lavender in color due to a dye. It had a low viscosity similar to that for diesel oil. The specific gravity of the heating oil was found to be 0.85.

A sample of the heating oil was placed in the freezer at −15° C. It became cloudy like diesel oil. However, it was noticed that when the sample was warmed the haze disappeared faster than that of diesel oil resulting in a crystal clear sample at −2° C. noting that the temperature of clearing for diesel oil is 0° C.

The sulfur level of the heating oil was not known. It was assumed to be 400 ppm. This value was chosen arbitrarily. Of course, in actual practice the correct assay value for the sulfur in the heating oil is known so that the correct stoichiometric amount of sodium bicarbonate can be calculated. For these experiments the sulfur content of the heating oil was assumed to be 400 ppm in order to calculate the sodium bicarbonate requirement.

EXAMPLE 5

Variations in the Water-Soluble Alcohol, Octanol-1 and the Acetylenic Diol Surfactant Using Heating Oil In Experiment Number 11, 100% methanol is used whereas in Experiment Number 12, v/v 75/25 methanol/95% ethanol is used. In Experiment Number 13, the acetylenic diol surfactant is omitted for comparison to Experiment Number 12 that contained both octanol-1 and the surfactant.

| Experiment Number | 11 | 12 | 13 |
|---|---|---|---|
| Oleic acid | 30 | 30 | 30 |
| Octanol-1 | 10 | 10 | 10 |
| Acetylenic Diol Surfactant, gms. | 2.2 | 2.2 | 0 |
| 2-Ethylhexanol-1, gms. | 2.2 | 2.2 | 0 |
| Methanol | 28 | 21 | 21 |
| 95% Ethanol | 0 | 7 | 7 |
| Added water | 10 | 10 | 10 |
| 29% Aqueous Ammonia | 4.0 | 4.0 | 4.0 |
| Urea, gms. | 2.20 | 2.20 | 2.20 |
| Ethyl Carbamate, gms. | 2.20 | 2.20 | 2.20 |
| Sodium Bicarbonate, gms. | 0.29 | 0.29 | 0.27 |

Crystal clear microemulsion fuels of v/v 65/35 heating oil/Additive were prepared at room temperature. The crystal clear W/O microemulsions were placed in a freezer at −15° C. overnight and then examined. All three samples were more hazy than the heating oil sample but importantly, there was not any phase separation.

There was not any difference between #11 and #12 giving the conclusion that replacing 25% of the methanol with 95% ethanol did not improve the low temperature stability of the W/O microemulsion.

No differences could be discerned between #12 and #13 giving the conclusion that octanol-1 is as good as the combination of octanol-1 and the acetylenic diol surfactant regarding low temperature stability of the microemulsion. Again, it is important to note that this conclusion applies to the particular water content and percentages of urea and ethyl carbamate in the formulations.

When the samples were warmed all of them cleared at 1° C. The conclusion is that the W/O microemulsions containing about 1% urea and 1% ethyl carbamate and also containing the stoichiometric amount of sodium oleate to neutralize sulfur acids have excellent stability.

The percent Weight Compositions of the Microemulsions are shown in TABLE 5.

TABLE 5

Percent Weight Compositions of Microemulsions from Formulations of Experiments #11, #12 and #13 Experiment Number 11 12 13

TABLE 5

| Experiment Number | 11 | 12 | 13 |
|---|---|---|---|
| Heating oil | 62.90 | 62.90 | 62.90 |
| Free oleic acid | 4.04 | 4.04 | 4.30 |
| Ammonium oleate | 8.53 | 8.54 | 9.03 |
| Sodium Oleate | 0.48 | 0.48 | 0.48 |
| Octanol-1 | 3.85 | 3.85 | 4.07 |
| Acetylenic Diol Surfactant | 1.01 | 1.01 | 0.00 |
| 2-Ethylhexanol-1 | 1.01 | 1.01 | 0.00 |
| Methanol | 10.29 | 7.72 | 8.17 |
| Ethanol (Calcd. as 100%) | 0.00 | 2.43 | 2.57 |
| Water | 5.85 | 5.98 | 6.32 |
| Urea | 1.02 | 1.02 | 1.08 |
| Ethyl Carbamate | 1.02 | 1.02 | 1.08 |

EXAMPLE 6

Investigation of Increased Percentages of Urea and Ethyl Carbamate in the W/O Microemulsion Fuels

| Experiment Number | 14 | 15 | 16 |
|---|---|---|---|
| Oleic acid | 30 | 30 | 30 |
| Octanol-1 | 10 | 10 | 10 |
| Acetylenic Diol Surfactant, gms. | 2.2 | 2.2 | 2.2 |
| 2-Ethylhexanol-1, gms. | 2.2 | 2.2 | 2.2 |
| Methanol | 21 | 21 | 21 |
| 95% Ethanol | 7 | 7 | 7 |
| Added water | 10 | 14 | 14 |
| 29% Aqueous Ammonia | 4.0 | 4.0 | 4.0 |
| Urea, gms. | 2.20 | 4.40 | 8.80 |
| Ethyl Carbamate, gms. | 2.20 | 4.40 | 8.80 |
| Sodium Bicarbonate, gms. | 0.29 | 0.29 | 0.29 |

The W/O microemulsions prepared from these formulations were crystal clear at room temperature. They were placed in the freezer at −15° C. for two days and then rated for stability at sub-freezing temperatures.

All of the samples were rated as having excellent stability.. The appearance of the microemulsions of experiments 15 and 16 were similar to that of 100% heating oil and actually less hazy than the sample of experiment #14. Since both #15 and #16 contained more water in the microemulsion than #14, it may be that the higher water content enhanced the low temperature stability because of better solubility of urea and ethyl carbamate at the higher water content.

The clearing temperatures were also lower for samples #15 and #16 compared to both the 100% fuel oil sample and sample #14. They cleared at −4° C. whereas the heating oil sample cleared at −1° C. and sample #14 cleared at +1° C.

The conclusion of all of these experiments is that stable W/O microemulsions can be readily prepared with heating oil that contain mixtures of the NOx scavengers, urea and ethyl carbamate at high percentages in the microemulsions, and also contain the stoichiometric amount of sodium oleate (from reaction of sodium bicarbonate with oleic acid) that neutralizes sulfur acids such as sulfurous acid generated in the combustion chamber.

Also, combustion will be more complete with less formation of soot for the same reason that the microemulsions with diesel oil give lower particulate matter in the exhaust gases from the internal combustion engine.

The Percent Weight Compositions of the microemulsions are shown in TABLE 6.

TABLE 6

Percent Weight Compositions of the Microemulsions from the Formulations of Experiments #14, #15 and #16

| Experiment Number | 14 | 15 | 16 |
|---|---|---|---|
| Heating Oil | 62.90 | 61.70 | 59.30 |
| Free oleic acid | 4.04 | 3.75 | 3.63 |
| Ammonium oleate | 8.54 | 7.98 | 7.71 |
| Sodium oleate | 0.48 | 0.47 | 0.45 |
| Octanol-1 | 3.85 | 3.59 | 3.47 |
| Acetylenic Diol Surfactant | 1.01 | 0.95 | 0.91 |
| 2-Ethylhexanol-1 | 1.01 | 0.94 | 0.91 |
| Methanol | 7.72 | 7.21 | 6.97 |
| Ethanol (Calcd. as 100%) | 2.43 | 2.27 | 2.19 |
| Total water | 5.98 | 7.32 | 7.08 |
| Urea | 1.02 | 1.91 | 3.69 |
| Ethyl Carbamate | 1.02 | 1.91 | 3.69 |

I claim:

1. A low viscosity microemulsion fuel for the internal combustion engine and heating oil furnaces that is stable over a wide range of temperatures including temperatures below the freezing point of water, prepared by low shear mixing of a petroleum product with an additive wherein the additive is a clear, low viscosity solution comprising an anionic surfactant derived from the partial neutralization of an unsaturated fatty acid or a blend of unsaturated fatty acids with ammonia, a non-ethoxylated non-ionic surfactant, water-insoluble long chain aliphatic alcohols, water-soluble aliphatic alcohols, water, nitrogen oxide (NOx) scavengers consisting of urea and ethyl carbamate or mixtures thereof, and the stoichiometric amount of the sodium salt of the unsaturated fatty acid for neutralizing sulfur acids derived from the sulfur present in the petroleum product when it is oxidized during combustion of the microemulsion fuel.

2. Claim 1 in which the microemulsion fuel is a water-in-oil microemulsion fuel for the internal combustion engine comprising diesel oil/additive.

3. Claim 1 in which the microemulsion fuel is a water-in-oil microemulsion fuel for power plants and home furnaces comprising heating oil/additive.

4. Claims 2 and 3 in which the volume/volume ratio of diesel oil/additive and heating oil/additive is from 50/50 to 90/10.

5. Claim 1 in which the unsaturated fatty acids comprise oleic, linoleic and linolenic acids alone or in a blend and with said unsaturated fatty acids comprising at least 90% of the fatty acids such that there are present only minor percentages of saturated fatty acids such as lauric, myristic, palmitic and stearic acids in less than 10%.

6. Claim 1 in which the extent of the neutralization of the unsaturated fatty acids with ammonia is from 60 to 70 mole percent.

7. Claim 1 in which the ammonium salts of the unsaturated fatty acids comprise 2 to 10 percent by weight of the microemulsion fuel and represents the anionic surfactant.

8. Claim 1 in which there are free fatty acids in the microemulsion fuel from 1 to 5 percent by weight.

9. Claim 1 in which the urea NOx scavenger comprises from 0.01 to 4.0 percent by weight of the microemulsion.

10. Claim 1 in which the ethyl carbamate NOx scavenger comprises from 0.01 to 4.0 percent by weight of the microemulsion fuel.

11. Claim 1 in which the microemulsion fuel contains a blend of urea and ethyl carbamate NOx scavengers comprising from 0.01 to 4.0 percent by weight of urea and 0.01 to 4.0 percent by weight of ethyl carbamate.

12. Claim 1 in which the non-ionic surfactant is 2,4,7,9-tetramethyl-5-decyne-4,7-diol and is dissolved in the solvent 2-ethylhexanol-1 and the non-ionic surfactant and the solvent are present in the microemulsion fuel from 1 to 5 percent each by weight of the microemulsion fuel.

13. Claim 1 in which the water-insoluble long chain aliphatic alcohols have melting points below 0° C. and are selected from the group consisting of such as octanol-1, octanol-2, nonanol-1, nonanol-2, nonanol-3, pentanol-1 and 2-ethylhexanol-1.

14. Claim 13 in which the water-insoluble long-chain aliphatic alcohols comprise 1 to 10% by weight of the microemulsion fuel.

15. Claim 1 in which the water-insoluble long- chain aliphatic alcohols consist of a blend of long-chain, water-insoluble aliphatic alcohols melting below 0° C. and long-chain water-insoluble aliphatic alcohols melting above 0° C. is used.

16. Claim 15 in which the water-insoluble long-chain aliphatic alcohol melting below 0° C. comprises 1 to 10% by weight and the water-insoluble long-chain aliphatic alcohol melting above 0° C. comprises 1 to 5% by weight of the microemulsion fuel.

17. Claim 1 in which the non-ionic surfactant comprises 1 to 2% and the water-insoluble long-chain aliphatic alcohols consist of a blend in which those melting below 0° C. comprise 1 to 10% and those melting above 0° C. comprise 1 to 5% by weight of the microemulsion fuel.

18. Claim 1 in which the water-soluble aliphatic alcohol is methanol, ethanol and isopropanol, or mixtures thereof.

19. Claim 18 in which the water-soluble alcohols are present in the microemulsion fuel from 6 to 14 percent by weight.

20. Claim 1 in which the total water content of the microemulsion fuel is between 1 and 10 percent by weight of the microemulsion.

21. Claim 1 in which the stoichiometric amount of the sodium salt of the unsaturated fatty acid in the microemulsion fuel is formed from the reaction of an alkaline substance such as sodium bicarbonate and sodium carbonate with the unsaturated fatty acid.

* * * * *